US008993824B2

(12) United States Patent
Mehlberg

(10) Patent No.: US 8,993,824 B2
(45) Date of Patent: Mar. 31, 2015

(54) FLUID CATALYTIC CRACKING PROCESS

(75) Inventor: Robert L. Mehlberg, Wheaton, IL (US)

(73) Assignee: UOP LLC, Des Plaines, IL (US)

( * ) Notice: Subject to any disclaimer, the term of this patent is extended or adjusted under 35 U.S.C. 154(b) by 295 days.

(21) Appl. No.: 13/247,413

(22) Filed: Sep. 28, 2011

(65) Prior Publication Data

US 2013/0079569 A1 Mar. 28, 2013

(51) Int. Cl.

| | |
|---|---|
| ***C07C 4/06*** | (2006.01) |
| ***C10G 51/02*** | (2006.01) |
| ***C10G 51/06*** | (2006.01) |
| ***C10G 11/05*** | (2006.01) |
| ***C10G 11/18*** | (2006.01) |

(52) U.S. Cl.

CPC ..... *C10G 51/026* (2013.01); *C10G 51/06* (2013.01); *C10G 11/05* (2013.01); *C10G 11/18* (2013.01); *C10G 2400/20* (2013.01); *C10G 2400/22* (2013.01)

USPC ..... 585/653; 585/648; 585/649; 585/650; 585/651; 208/113; 208/106

(58) Field of Classification Search

USPC ..... 585/648, 649, 650, 651, 653; 208/70, 208/49, 74, 120, 153, 118, 119, 120.1, 113

See application file for complete search history.

(56) References Cited

U.S. PATENT DOCUMENTS

| | | | | |
|---|---|---|---|---|
| 5,011,506 | A | 4/1991 | Harandi et al. | |
| 5,047,070 | A | 9/1991 | Harandi et al. | |
| 5,144,085 | A | 9/1992 | Harandi et al. | |
| 5,166,455 | A | 11/1992 | Chin et al. | |
| 5,347,064 | A | 9/1994 | Child et al. | |
| 5,658,453 | A | 8/1997 | Russ et al. | |
| 6,090,271 | A | 7/2000 | Carpency et al. | |
| 6,190,534 | B1 | 2/2001 | Bogdan | |
| 6,791,002 | B1 * | 9/2004 | Abrevaya et al. | 585/648 |
| 7,008,527 | B2 | 3/2006 | Gauthier et al. | |
| 7,247,233 | B1 | 7/2007 | Hedrick et al. | |
| 7,262,332 | B2 | 8/2007 | Duplan et al. | |
| 7,312,370 | B2 | 12/2007 | Pittman et al. | |
| 7,374,662 | B2 | 5/2008 | Duplan et al. | |
| 7,476,773 | B2 | 1/2009 | Louret et al. | |
| 7,566,811 | B2 | 7/2009 | Louret et al. | |
| 7,655,822 | B2 | 2/2010 | Ross et al. | |
| 2005/0006279 | A1 | 1/2005 | Gueret et al. | |
| 2009/0299118 | A1 | 12/2009 | Claude | |

(Continued)

FOREIGN PATENT DOCUMENTS

| | | |
|---|---|---|
| WO | 9208683 | 5/1992 |
| WO | 2010067379 A2 | 6/2010 |

OTHER PUBLICATIONS

Abstract of WO 2010/023369 A1, Published Mar. 4, 2010 by IFP.

(Continued)

*Primary Examiner* — In Suk Bullock
*Assistant Examiner* — Sharon Pregler

(57) ABSTRACT

One exemplary embodiment can be a process for fluid catalytic cracking. The process may include providing a first feed having a boiling point of about 180-about 800° C. to a first riser reactor, and providing a second feed having first and second parts to a second reactor. Typically, the first part includes one or more C5-C12 hydrocarbons and a second part includes one or more C4-C5 hydrocarbons. Generally, an effective amount of the second part is combined with the first part to maximize production of propene.

19 Claims, 2 Drawing Sheets

(56) References Cited

U.S. PATENT DOCUMENTS

| | | | |
|---|---|---|---|
| 2010/0147744 | A1 | 6/2010 | Palmas et al. |
| 2010/0158767 | A1 | 6/2010 | Mehlberg et al. |
| 2010/0168488 | A1 | 7/2010 | Mehlberg et al. |
| 2010/0236980 | A1 | 9/2010 | Upson et al. |
| 2010/0286459 | A1 | 11/2010 | Gauthier et al. |
| 2010/0331596 | A1 | 12/2010 | Xie et al. |

OTHER PUBLICATIONS

Knight et al., "Creating Opportunities from Challenges: Maximizing Propylene Yields from Your FCC", UOP LLC, a Honeywell Company, 2011, vol. AM-11-06, 17 Pages.
Li et al., "Maximizing Propylene Yield by Two-Stage Riser Catalyic Cracking of Heavy Oil", Industrial & Engineering Chemisty Research, Jul. 4, 2007, vol. 46, No. 14, pp. 4914-4920.
Mehlberg, "Advances in Propylene Production from FCC: UOP RxPro Max C3=Technology", Middle East Petrotech 2010, May 23-26, 2010, Bahrain, May 2010, 16 Pages.
Mehlberg et al., "Creating Opportunities from Challenges: Maximizing Propylene Yields from Your FCC", NPRA 2011 Annual Meeting, Mar. 21-22, 2011, San Antonio, TX, Mar. 2011, 21 Pages.
Roux, "Resid to Petrochemicals Technology", ARTC 12th Annual Meeting, Mar. 10-12, 2009 Kuala Lumpur, Mar. 2009, 29 Pages.
Roux, "Resid to Petrochemicals Technology", 7th FCC Forum Apr. 24-27, 2007, Lyon, France, Apr. 2007, 32 Pages.
Verstraete et al., "Study of Direct and Indirect Naphtha Recycling to a Resid FCC Unit for Maximum Propylene Production", Catalysis Today, Oct. 15, 2005, vol. 106, No. 1-4, pp. 62-71.
Search Report dated Jan. 31, 2013 for corresponding PCT Appl. No. PCT/US2012/052587.

* cited by examiner

FLUID CATALYTIC CRACKING PROCESS

FIELD OF THE INVENTION

This invention generally relates to a fluid catalytic cracking process.

DESCRIPTION OF THE RELATED ART

Catalytic cracking can create a variety of products from larger hydrocarbons. Often, a feed of a heavier hydrocarbon, such as a vacuum gas oil, is provided to a catalytic cracking reactor, such as a fluid catalytic cracking reactor. Various products may be produced from such a system, including a gasoline product and/or a light product such as propene and/or ethene.

In such systems, a single reactor or a dual reactor can be utilized. Although additional capital costs may be incurred by using a dual reactor system, one of the reactors can be operated to tailor conditions for maximizing products, such as light olefins including propene and/or ethene.

In such dual reactor systems, high yields of butene, such as about 70-about 150%, or even about 100-about 300%, by weight, based on propene yield, can occur during cracking of either light cracked naphtha or polymer naphtha. Yields may be especially high for polymer naphtha because the naphtha is almost entirely composed of dimers and trimers of butene. Generally, this is undesirable as, historically, propene has been a more valuable product than butene. As a consequence, there is a desire to improve the selectivity of such feeds and dual reactor systems to produce propene.

SUMMARY OF THE INVENTION

One exemplary embodiment can be a process for fluid catalytic cracking. The process may include providing a first feed having a boiling point of about 180-about 800° C. to a first riser reactor, and providing a second feed having first and second parts to a second reactor. Typically, the first part includes one or more C5-C12 hydrocarbons and a second part includes one or more C4-C5 hydrocarbons. Generally, an effective amount of the second part is combined with the first part to maximize production of propene.

Another exemplary embodiment may be a process for fluid catalytic cracking. The process can include providing at least one of a gas oil, a vacuum gas oil, an atmospheric gas oil, a coker gas oil, a hydrotreated gas oil, a hydrocracker unconverted oil, and an atmospheric residue to a first riser reactor, and providing a light cracked naphtha and/or a polymer naphtha combined with an effective amount of at least one C4 and C5 hydrocarbon to a second riser reactor to maximize production of propene.

Yet another exemplary embodiment can be a process for fluid catalytic cracking. The process may include providing at least one of a gas oil, a vacuum gas oil, an atmospheric gas oil, a coker gas oil, a hydrotreated gas oil, a hydrocracker unconverted oil, and an atmospheric residue to a first riser reactor operating at a temperature of about 150-about 580° C., providing a light cracked naphtha and/or a polymer naphtha combined with an effective amount of at least one C4 and C5 hydrocarbon to a second riser reactor operating at a temperature of about 425-about 630° C. to maximize production of propene, providing a catalyst to at least one of the first and second riser reactors, and regenerating the catalyst in a regeneration zone.

The embodiments disclosed herein add one or more C4-C5 hydrocarbons, preferably one or more C4 and C5 alkenes, which can shift the reaction equilibrium to produce more propene. By including, e.g., butene in a feed including a naphtha, light cracked naphtha, or polygas to e.g., a second riser, propene selectivity can be enhanced and overall recycle rates and gas yields may be minimized.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "rich" can mean an amount of generally at least about 50%, and preferably about 70%, by mole, of a compound or class of compounds in a stream.

As used herein, the term "substantially" can mean an amount of generally at least about 80%, preferably about 90%, and optimally about 99%, by mole, of a compound or class of compounds in a stream.

As used herein, the terms "alkane", "paraffin", and "saturate" may be used interchangeably.

As used herein, the terms "alkene" and "olefin" may be used interchangeably.

As used herein, the term "butene" can include but-1-ene, cis-2-butene, trans-2-butene, and/or 2-methylpropene.

As used herein, the term "pentene" can include 1-pentene, cis-2-pentene, trans-2-pentene, 2-methylbut-1-ene, 3-methylbut-1-ene, and/or 2-methylbut-2-ene.

As used herein, the term "light cracked naphtha" may be abbreviated "LCN".

As used herein, the term "fluid catalytic cracking" may be abbreviated "FCC".

As used herein, the term "dry gases" may include hydrogen, hydrogen sulfide, methane, ethane, and ethene, and can be abbreviated "DG".

As used herein, the term "weight percent" may be abbreviated "wt. %".

As used herein, the term "riser reactor" generally means a reactor used in a fluid catalytic cracking process that can include a riser and a reaction vessel. Usually, such a reactor has catalyst provided at a bottom of a riser and the catalyst proceeds to a reaction vessel having a mechanism for separating the catalyst from a hydrocarbon.

DETAILED DESCRIPTION

Figure 1:
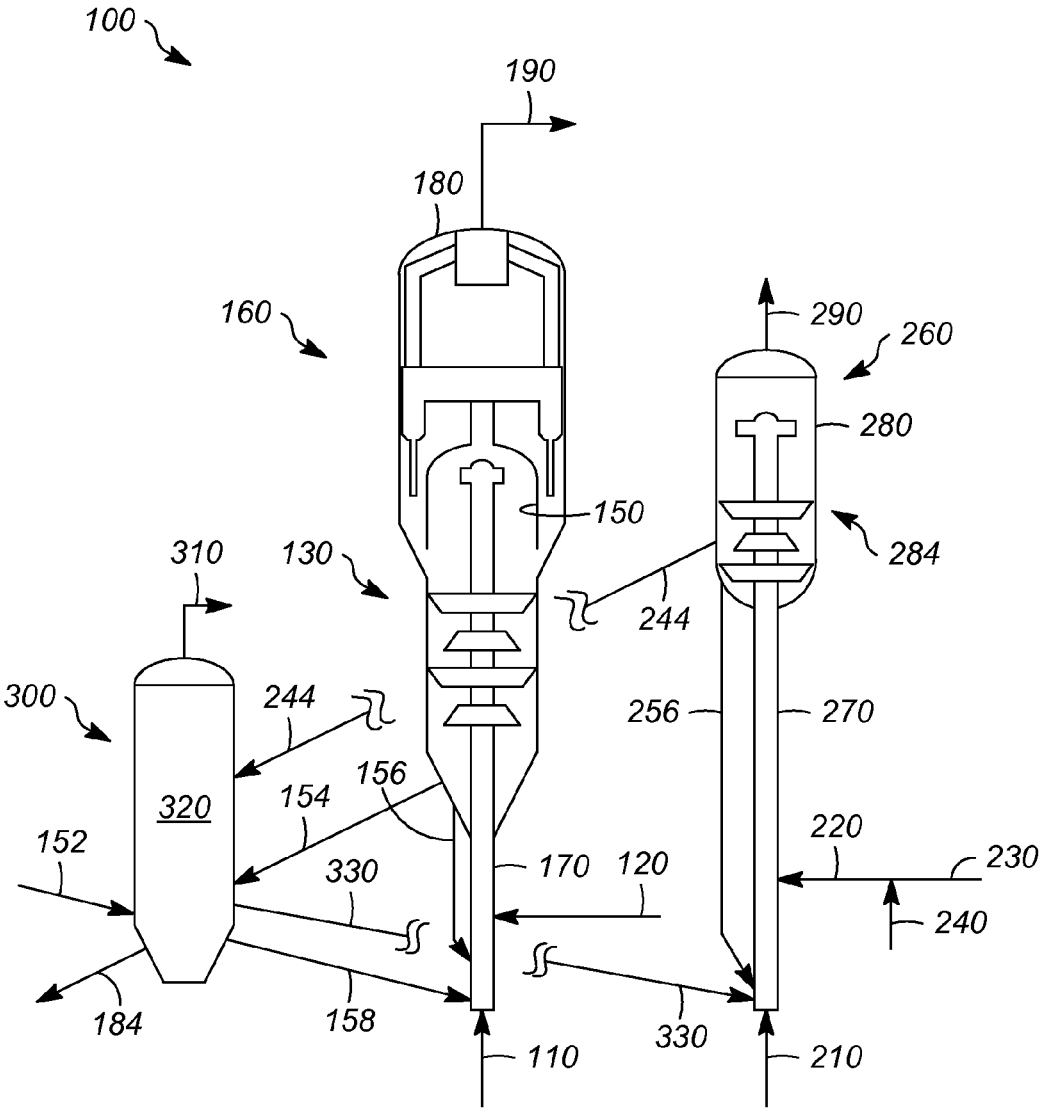
FIG. 1 is a schematic depiction of an exemplary fluid catalytic cracking zone.

Referring to FIG. 1, an exemplary fluid catalytic cracking zone 100 can include a first riser reactor 160, a second riser reactor 260, and a regeneration zone 300. An exemplary dual riser system is disclosed in, e.g., US 2010/0236980.

The first riser reactor 160 can include a riser 170 terminating in a reaction vessel 180. Usually, the first riser reactor 160 can further include a stripper zone 130 including one or more baffles and an internal shell 150. The second riser reactor 260 can include a riser 270 terminating in a reaction vessel 280. Typically, the second riser reactor 260 can also include a stripping zone 284.

Usually, a first feed 120 having a boiling point of about 180-about 800° C., typically a boiling point no less than about 350° C., is provided above a fluidizing gas 110 in the riser 170. These fluids and catalyst can rise within the riser 170 to the reaction vessel 180. Generally, the reactants and catalysts can be separated by one or more swirl arms with the product gases rising within the reaction vessel 180 to exit as a product stream 190 and the catalyst dropping. A portion of the catalyst can be provided via a first catalyst line 154 to the regeneration zone 300, and another portion passing through a line 156 may be provided at the base of the riser 170 to maximize the ratio of catalyst to oil. Usually, the first riser reactor 160 operates at a temperature of about 450-about 600° C. and processes heavy hydrocarbons, e.g., those feeds boiling at no less than about 350° C.

The second riser reactor 260 can receive a second feed 220 that can include at least about 20%, by weight, one or more C4 hydrocarbons, preferably one or more C4-C5 alkenes, such as butene. Preferably, at least about 30%, by weight, of the one or more C4-C5 alkenes, such as butene, are provided based on the weight of the second feed 220. Desirably, the second feed has about 30-about 80%, by weight, of one or more butenes based on the amount of the one or more alkenes in the second feed 220. The second feed 220 can include a first part 230 and a second part 240. The first part 230 can include a naphtha having one or more C5-C12 hydrocarbons, and typically can include a light cracked naphtha, which can include at least one C5-C7 hydrocarbon, and/or a polymer naphtha, which can include at least one C8-C12 hydrocarbon.

The second part 240 can include one or more C4-C5 hydrocarbons, typically one or more C4-C5 alkenes, such as at least one of butene and pentene. Generally, an effective amount of the second part 240 is combined with the first part 230 to maximize the production of propene by changing the reaction equilibrium by providing, e.g., butene and/or pentene, which can be products of the reaction. Although not wanting to be bound by theory, butene and/or pentene in the feed shifts the reaction from producing these compounds to producing more of other compounds, e.g., propene.

The second feed 220 can be provided above a fluidizing stream 210 to enable the reactants to react within the riser 270. The catalyst and products may rise to a separating device, such as swirl arms, with the catalyst dropping within the reaction vessel 280 and the gases rising and exiting as a second product stream 290. The catalyst can be provided via a line 244 to a regenerator 320 in the regeneration zone 300 with another portion traveling via a line 256 to the base of the riser 270. Similarly as discussed above, this catalyst from the reaction vessel 280 may maximize the ratio of catalyst to oil. Typically, the reaction vessel 280 can eliminate the net production of butene with respect to the feed 220 for the second riser reactor 260. Usually, the second riser reactor 260 operates at a temperature of about 425-about 630° C., and at a temperature greater than the first riser reactor 160.

The regeneration zone 300 can include the regeneration vessel 320 that may receive spent catalyst via lines 154 and 244, and provides regenerated catalyst via a line 158 to the base of the first riser 170 and via the line 330 to the base of the second riser 270. Usually, the regenerator 320 may receive make-up catalyst through a line 152 and equilibrium catalyst may be withdrawn via a line 184 to maintain catalyst activity. Typically, the regeneration vessel 320 may be operated at about 650-about 800° C. Generally, a flue gas 310 can exit the regeneration vessel 320. Exemplary regeneration vessels are disclosed in, e.g., U.S. Pat. No. 7,312,370 and U.S. Pat. No. 7,247,233.

The catalyst can be a single catalyst or a mixture of different catalysts. Usually, the catalyst includes two components or catalysts, namely a first component or catalyst, and a second component or catalyst. Such a catalyst mixture is disclosed in, e.g., U.S. Pat. No. 7,312,370.

Generally, the first catalyst may include any of the catalysts that are used in the art of FCC, such as an active amorphous clay-type catalyst and/or a high activity, crystalline molecular sieve. Zeolites may be used as molecular sieves in FCC processes. Preferably, the first catalyst includes a large pore zeolite, such as a Y-type zeolite, an active alumina material, a binder material, including either silica or alumina, and an inert filler such as kaolin.

Typically, the zeolitic molecular sieves appropriate for the first catalyst have a large average pore size. Usually, molecular sieves with a large pore size have pores with openings of greater than about 0.7 nm in effective diameter defined by greater than about 10, and typically about 12, member rings. Pore Size Indices of large pores can be above about 31. Suitable large pore zeolite components may include synthetic zeolites such as X and Y zeolites, mordenite and faujasite. A portion of the first catalyst, such as the zeolite, can have any suitable amount of a rare earth metal or rare earth metal oxide.

The second catalyst may include a medium or smaller pore zeolite catalyst, such as an MFI zeolite, as exemplified by at least one of ZSM-5, ZSM-11, ZSM-12, ZSM-23, ZSM-35, ZSM-38, ZSM-48, and other similar materials. Other suitable medium or smaller pore zeolites include ferrierite, and erionite. Preferably, the second catalyst has the medium or smaller pore zeolite dispersed on a matrix including a binder material such as silica or alumina and an inert filler material such as kaolin. The second catalyst may also include some other active material such as Beta zeolite. These compositions may have a crystalline zeolite content of about 10-about 50 wt. % or more, and a matrix material content of about 50-about 90 wt. %. Components containing about 40 wt. % crystalline zeolite material are preferred, and those with greater crystalline zeolite content may be used. Generally, medium and smaller pore zeolites are characterized by having an effective pore opening diameter of less than or equal to about 0.7 nm, rings of about 10 or fewer members, and a Pore Size Index of less than about 31.

In the embodiments disclosed herein, the selectivity of propene may be enhanced by feeding butene and/or pentene, preferably butene, to a naphtha cracking riser. Although not wanting to be bound by theory, co-feeding butene and/or pentene with a light cracked naphtha and/or polymer naphtha may shift equilibrium of reaction to the production of propene, and hence improve propene selectivity.

ILLUSTRATIVE EMBODIMENTS

The following examples are intended to further illustrate the subject catalyst. These illustrations of embodiments of the invention are not meant to limit the claims of this invention to the particular details of these examples. These examples are based on engineering calculations and actual operating experience with similar processes.

In the following examples, three feeds are provided to a pilot plant. The feeds are an LCN having 30%, by weight, alkenes, based on the weight of the LCN (abbreviated "F1"), one or more C4 hydrocarbons having 59%, by weight, alkenes, based on the weight of the one or more C4 hydrocarbons (abbreviated "F2"), and a 50/50% blend of F1 and F2 with 45%, by weight, alkenes, based on the weight of the blend (abbreviated "F3"). Moreover, F1 may also have 3.2%, by weight, one or more butenes in alkenes, F2 can also have 100%, by weight, one or more butenes in alkenes, and F3 may also have 66.8%, by weight, of one or more butenes in alkenes. The pilot plant utilizes a blend of large and medium pore zeolite catalysts. The blend consists 75%, by weight, commercial high propene FCC catalyst deactivated to commercial activity by steaming for 7 hours at 774° C. and 25%, by weight, of a commercial 40%, by weight, ZSM-5 additive, steamed for 24 hours at 774° C. The final catalyst mixture contains about 14%, by weight, ZSM-5 based on the phosphorus content. The pilot plant having an isothermal riser reactor is operated at a temperature of 566° C., a riser pressure of 270 kPa, a feed partial pressure of 140 kPa, and a weight ratio of catalyst to oil of 8:1-12:1.

The amount of alkanes, dry gases (DG), propene, butene, pentene, and C6-C12 alkenes products having the formula $C_nH_{2n}$ where n is the carbon number of the alkene are measured using a combination of methods. The gaseous products are analyzed by a multi-column refinery gas analyzer with thermal-conductivity and flame-ionization detectors. Liquid products are measured by a gas chromatograph utilizing analyzer software and the gasoline specification is determined by analysis with a capillary gas chromatography with a flame-ionization detector. For DG and propene, there are no measurable amounts of these components in the feed. The weight percent (sum may not total 100% due to rounding) of components for the feeds and respective products is depicted in the table below:

TABLE 1

| | F1 Weight Percent | | F2 Weight Percent | | F3 Weight Percent | |
|---|---|---|---|---|---|---|
| Component | Feed | Product | Feed | Product | Feed | Product |
| DG | 0 | 2.5 | 0 | 2.0 | 0 | 1.7 |
| Propene | 0 | 10.4 | 0 | 12.4 | 0 | 10.3 |
| Butene | 1.0 | 8.4 | 59.2 | 31.7 | 30.1 | 21.2 |
| Pentene | 12.9 | 6.0 | 0 | 8.6 | 6.4 | 8.4 |
| C6-C12 Alkenes | 17.1 | 4.1 | 0 | 0 | 8.6 | 6.1 |
| Dienes and Cyclic Alkenes | 4.4 | 1.7 | 0 | 0.1 | 2.2 | 2.4 |
| Aromatics | 22.4 | 25.0 | 0 | 0 | 11.2 | 11.1 |
| Alkanes | 42.3 | 39.8 | 40.8 | 45 | 41.5 | 37.7 |
| Cycle Oils Plus Coke | 0 | 2.1 | 0 | 0.3 | 0 | 1.1 |

The net yield is determined by measuring and calculating the weight percent in the feed and product and subtracting, respectively, the weight percent of the feed from the weight percent of product for respectively, DG, propene, butene, pentene, and C6-C12 alkenes. As an example, the net yield for DG of F1 can be calculated:

$$2.5\%=2.5\%-0\%$$

The total converted alkenes and alkanes are calculated by summing only converted components, in other words, only those having negative yields. As an example for F1, the total converted alkenes and alkanes (except for dienes and cyclic alkenes) can expressed as weight percent and calculated as:

$$-22.4\%=(6.0-12.9)\%+(4.1-17.1)\%+(39.8-42.3)\%$$

For these feeds, the following net yields are obtained expressed as percentages and depicted in the table below:

TABLE 2

| | Net Yield Expressed as Weight Percent Based on Total Feed (Negative Values Denote Conversion) | | |
|---|---|---|---|
| | F1 3.2%, By Weight, Butenes in Alkenes | F2 100%, By Weight, Butenes in Alkenes | F3 66.8%, By Weight, Butenes in Alkenes |
| DG | 2.5 | 2.0 | 1.7 |
| Propene | 10.4 | 12.4 | 10.3 |
| Butene | 7.4 | −27.5 | −8.9 |
| Pentene | −6.9 | 8.6 | 1.9 |
| C6-C12 Alkenes | −13 | 0.0 | −2.4 |
| Alkanes | −2.5 | 4.2 | −3.9 |
| Cycle Oil Plus Coke | 2.1 | 0.3 | 1.1 |
| Total Converted Alkenes and Alkanes | −22.4 | −27.5 | −15.2 |

The ratio of selectivity yield divided by conversion can be calculated by dividing the net yield for, respectively, DG, propene, butene, pentene, and C6-C12 alkenes by the total converted alkenes and alkanes, as depicted in the last row of Table 2, and multiplying by a negative 100%. The net yield of alkanes is determined by subtracting the weight percent of alkanes in feed (F1, F2, and F3) from respective alkanes in the products for F1, F2, and F3. As an example, the ratio, which may be referred to as the "net selectivity ratio", can be calculated for DG of F1 can be calculated as:

$$11\%=-100*(2.5\%/-22.4\%)$$

The ratios are depicted as percentages of the converted alkenes in the table below:

TABLE 3

| | Selectivity Yield/Conversion Expressed as Weight Percent | | |
|---|---|---|---|
| | F1 3.2%, By Weight, Butenes in Alkenes | F2 100%, By Weight, Butenes in Alkenes | F3 66.8%, By Weight, Butenes in Alkenes |
| DG | 11% | 7% | 11% |
| Propene | 46% | 45% | 68% |
| Butene | 33% | −100% | −59% |
| Pentene | −31% | 31% | 13% |
| C6-C12 Alkenes | −58% | 0% | −16% |

Figure 2:
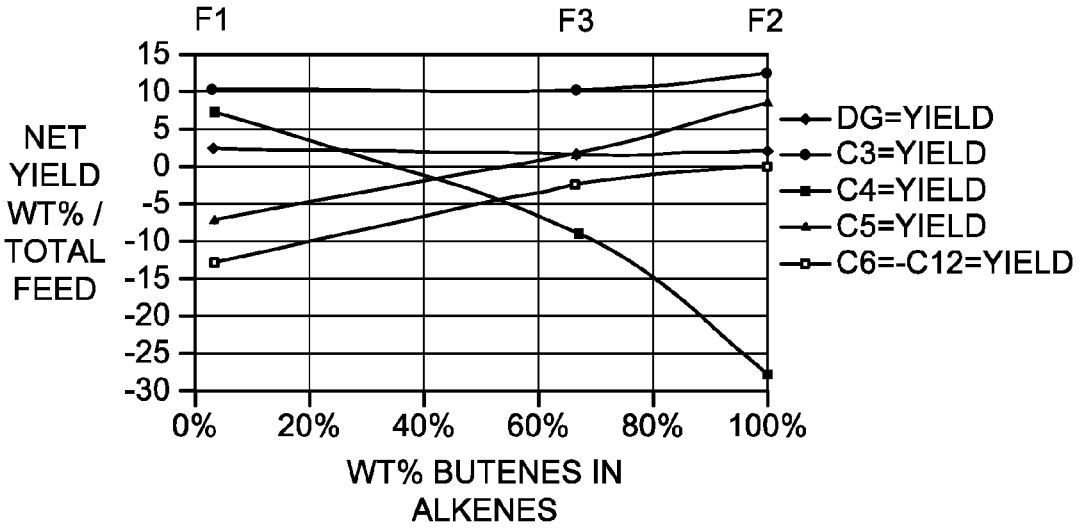
FIG. 2 is a graphical depiction of the net yield weight percent based on total feed versus weight percent of butenes in alkenes for three exemplary feeds.

Referring to FIG. 2, generally about 10-13%, by weight, propene yield is obtained for all three feeds. Moreover, the net yields of alkenes by carbon number as well as DG are plotted against the butene content of the feed alkenes. As depicted, negative numbers represent conversion of feed into products. With only F1 the butene yield is about 70%, by weight, of the propene yield, which limits propene selectivity and increases recycle costs. By including butene in the feed, net production of butene can be reduced or eliminated and, as depicted by feeds F2 and F3, butene can even be converted.

The yield for a component of F2 or F3 can be calculated by subtracting a quotient (F2/F1 or F3/F1) of a net yield of a component from one, and multiplying by 100%. As an example, the dry gas (DG) yield for F2 is calculated as follows:

$$20\%=100\%*(1-2.0\%/2.5\%)$$

As a consequence, the dry gas (DG) yields are reduced by 20% and 32%, by weight, for, respectively, F2 and F3 feeds as compared to the F1 feed. Referring to the tables above, cycle oils and coke yields are, respectively, 86% and 48%, by weight, lower for F2 and F3, respectively, as compared to the F1 feed.

Figure 3:
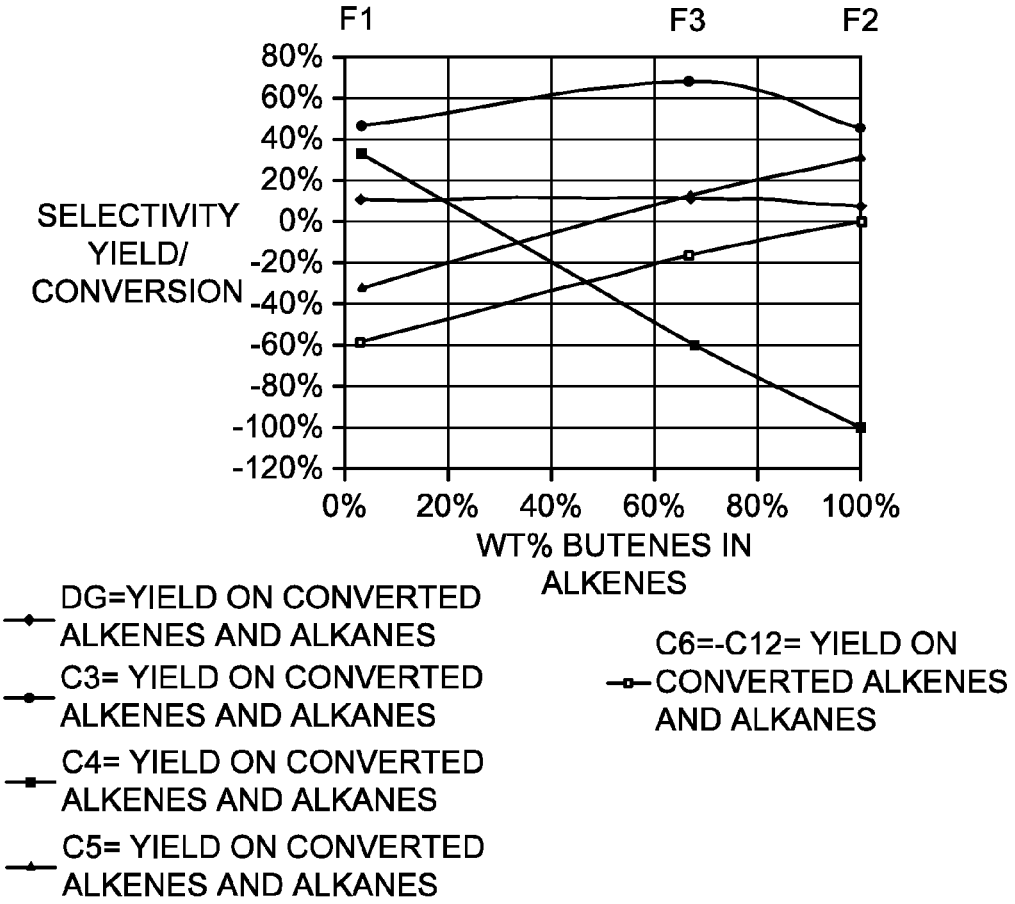
FIG. 3 is a graphical depiction of selectivity yield based on conversion versus weight percent butenes in alkenes for three exemplary feeds.

Referring to FIG. 3, the net selectivity ratios from Table 3 are plotted against the percentage of butenes in the feed alkenes. For F3, the propene net selectivity ratio is highest at about 68%, by weight, of converted alkenes and alkanes. For F1, at 3.2%, by weight, the propene net selectivity ratio is diminished to 46%, by weight, of converted alkenes and alkanes with a butene net selectivity ratio of 33%, by weight, and for F2, the propene net selectivity ratio is diminished to 45%, by weight, of converted alkenes and alkanes. Although not wanting to be bound by theory, it is believed that the propene net selectivity ratio is highest at about 30-about 80%, by weight, one or more butenes in one or more alkenes because butene and pentene should both show net conversion. By maximizing propene selectivity, overall recycle and gas, and coke and cycle oil yields can be minimized for a given target of propene yield. Thus, while F3 may produce slightly less propene on a give pass, F3 can exhibit higher selectivity, and thus results in the production of less by-products.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for fluid catalytic cracking, comprising:

A) providing a first feed having a boiling point of about 180-about 800° C. to a first riser reactor; and B) providing a second feed comprising first and second parts to a second riser reactor wherein a first part comprises a light cracked naphtha or a polymer naphtha of one or more C5-C12 hydrocarbons and a second part comprises one or more C4-05 hydrocarbons; whereby an effective amount of the second part is combined with the first part to maximize production of propene under cracking conditions, wherein the second feed comprises about 20 to about 80% by weight butenes based on the amount of alkenes in the second feed.

2. The process according to claim 1, wherein a net production of butene is eliminated with respect to a feed to the second riser reactor.

3. The process according to claim 1, wherein the first feed comprises at least one of a gas oil, a vacuum gas oil, an atmospheric gas oil, a coker gas oil, a hydrotreated gas oil, a hydrocracker unconverted oil, and an atmospheric residue.

4. The process according to claim 1, wherein the second feed comprises at least about 20%, by weight, one or more C4 hydrocarbons.

5. The process according to claim 1, wherein the second feed comprises at least about 30%, by weight, one or more C4 hydrocarbons.

6. The process according to claim 1, further comprising providing a catalyst comprising a medium pore zeolite to the first riser reactor and/or second riser reactor.

7. The process according to claim 1, wherein the first part comprises at least one C5-C7 hydrocarbon or at least one C8-C12 hydrocarbon.

8. The process according to claim 1, wherein the first part comprises at least one C5-C7 hydrocarbon.

9. The process according to claim 6, further comprising providing the catalyst to a regeneration zone.

10. The process according to claim 1, wherein each riser reactor comprises a riser terminating in a reaction vessel.

11. The process according to claim 1, wherein the first riser reactor operates at a temperature of about 150-about 580° C.

12. The process according to claim 1, wherein the second riser reactor operates at a temperature of about 425-about 630° C.

13. The process according to claim 1, wherein the second riser reactor operates at a temperature greater than a temperature of the first riser reactor.

14. A process for fluid catalytic cracking comprising:

A) providing a first feed comprising at least one of a gas oil, a vacuum gas oil, an atmospheric gas oil, a coker gas oil, a hydrotreated gas oil, a hydrocracker unconverted oil, and an atmospheric residue to a first riser reactor; and B) adding to a light cracked naphtha and/or a polymer naphtha an effective amount of at least one C4 and C5 hydrocarbon to form a second feed to a second riser reactor to maximize production of propene under cracking conditions, wherein the second feed comprises about 30 to about 80% by weight butenes based on the amount of alkenes in the second feed.

15. The process according to claim 14, wherein a net production of butene is eliminated with respect to a feed to the second riser reactor.

16. The process according to claim 1, wherein the first riser reactor operates at a temperature of about 150-about 580° C.

17. The process according to claim 1, wherein the second riser reactor operates at a temperature of about 425-about 630° C.

18. A process for fluid catalytic cracking comprising:

A) providing at least one of a gas oil, a vacuum gas oil, an atmospheric gas oil, a coker gas oil, a hydrotreated gas oil, a hydrocracker unconverted oil, and an atmospheric residue to a first riser reactor operating at a temperature of about 150-about 580° C.;

B) providing a light cracked naphtha and/or a polymer naphtha stream combined with an effective amount of at least one C4 and C5 hydrocarbon, having about 20 to about 80% by weight butenes based on the amount of alkenes present in the combined light cracked naphtha and/or a polymer naphtha stream and the effective amount of at least one C4 and C5 hydrocarbon, to a second riser reactor operating at a temperature of about 425-about 630° C. to maximize production of propene under cracking conditions;

C) providing a catalyst to at least one of the first and second riser reactors; and D) regenerating the catalyst in a regeneration zone.

19. The process according to claim 18, wherein the second riser reactor operates at a temperature greater than a temperature of the first riser reactor.

* * * * *